US005235121A

United States Patent [19]

Brinkmeyer et al.

[11] Patent Number: 5,235,121

[45] Date of Patent: Aug. 10, 1993

[54] METHOD FOR REFORMING HYDROCARBONS

[75] Inventors: Francis M. Brinkmeyer; Warren M. Ewert; Homer M. Fox, all of Bartlesville, Okla.; D. F. Rohr, Jr., Charlton, N.Y.

[73] Assignee: Phillips Petroleum Company, Bartlesville, Okla.

[21] Appl. No.: 739,823

[22] Filed: Aug. 2, 1991

[51] Int. Cl.[5] ..... C07C 15/02; C07C 2/00; C10G 35/06

[52] U.S. Cl. ..... 585/402; 585/400; 585/407; 585/419; 585/500; 585/654; 585/660; 585/661; 208/133; 208/134; 208/137; 208/138; 208/140; 502/38; 502/51; 502/52

[58] Field of Search ..... 585/350, 400, 402, 500, 585/654, 660, 661, 407, 419; 208/133, 134, 137, 138, 140; 502/38, 51, 52

[56] References Cited

U.S. PATENT DOCUMENTS

| | | | |
|---|---|---|---|
| 2,355,831 | 8/1944 | Voorhees | 196/52 |
| 2,587,425 | 2/1952 | Adams et al. | 196/50 |
| 2,906,696 | 9/1959 | Garbo et al. | 208/134 |
| 2,945,900 | 7/1960 | Alexander et al. | 260/669 |
| 3,615,839 | 10/1971 | Thompson et al. | 136/86 |
| 3,641,182 | 2/1972 | Box, Jr. et al. | 260/680 |
| 3,670,044 | 6/1972 | Drehman et al. | 260/683 |
| 3,725,493 | 4/1972 | Stine | 260/680 |
| 3,751,385 | 8/1973 | Manning et al. | 252/447 |
| 4,167,472 | 9/1979 | Dick et al. | 208/80 |
| 4,229,609 | 10/1980 | Hutson, Jr. et al. | 585/660 |
| 4,513,162 | 4/1985 | Al-Muddarris | 585/654 |
| 4,613,715 | 9/1986 | Haskell | 585/412 |

OTHER PUBLICATIONS

T. H. Arnold, Jr., "New Catalyst for Butadiene Unit", *Chemical Engineering*, Oct. 30, 1961, pp. 90–92.

*Primary Examiner*—Anthony McFarlane
*Assistant Examiner*—Nhat D. Phan
*Attorney, Agent, or Firm*—Dougherty, Hessin, Beavers & Gilbert

[57] ABSTRACT

The present invention provides a method and apparatus for reforming a hydrocarbon feedstock in the presence of steam using a steam-active reforming catalyst The present invention can generally be used in conjunction with any steam-active reforming processes wherein the hydrocarbon reforming and catalyst regeneration operations are conducted simultaneously and the catalyst is regenerated using a steam-diluted oxygen (or air) regeneration medium. In the present invention, catalyst regeneration effluent gas is advantageously reused in the reforming operation to provide at least a portion of the steam environment required for reforming the hydrocarbon feedstock. Free oxygen is preferably removed from the regeneration effluent gas before the regeneration effluent gas is brought into contact with the hydrocarbon feedstock.

15 Claims, 1 Drawing Sheet

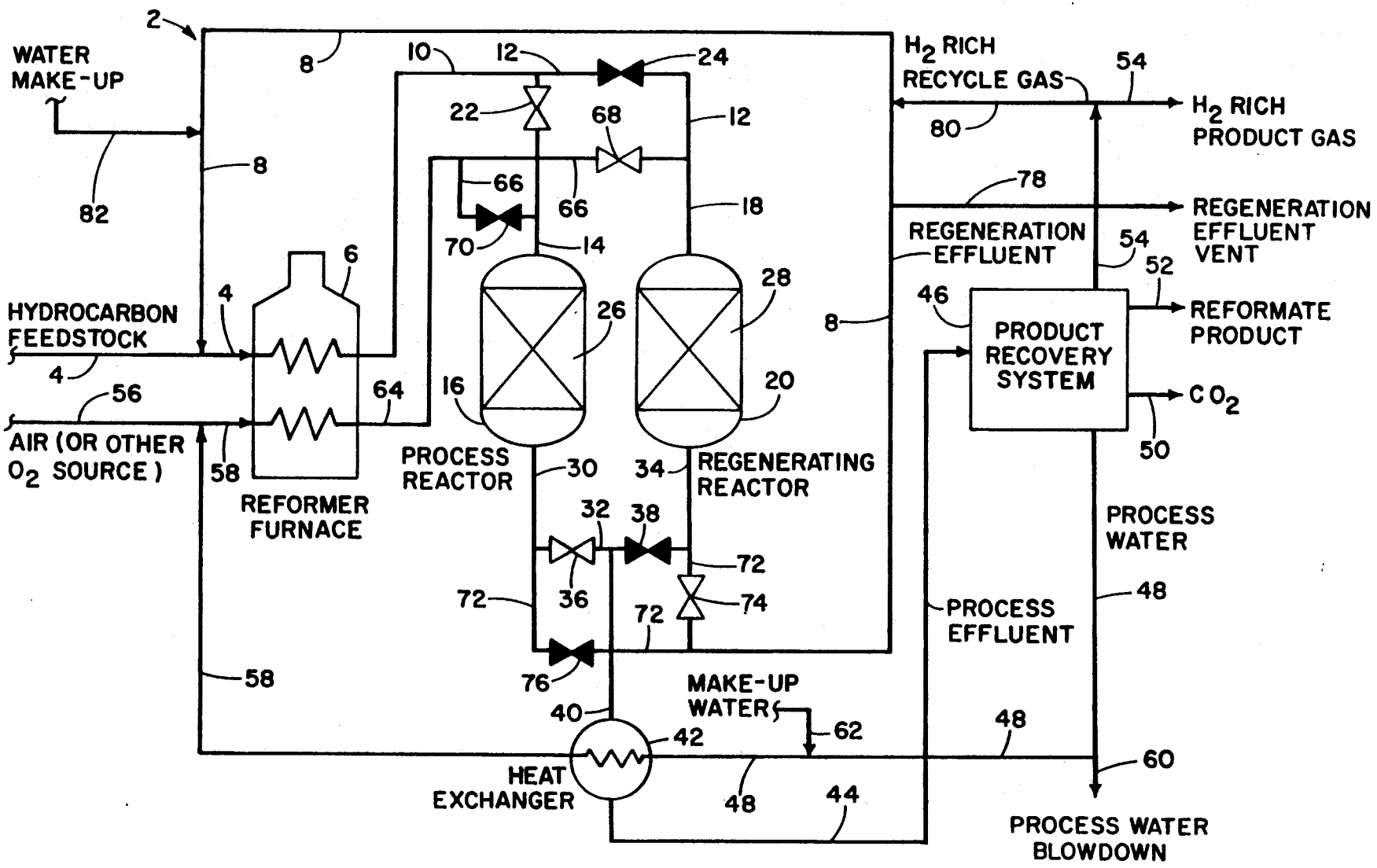
H2 RICH PRODUCT GAS
REGENERATION EFFLUENT VENT
REFORMATE PRODUCT
CO2
PROCESS WATER
PROCESS WATER BLOWDOWN
PRODUCT RECOVERY SYSTEM
H2 RICH RECYCLE GAS
REGENERATION EFFLUENT
PROCESS EFFLUENT
REGENERATING REACTOR
MAKE-UP WATER
HEAT EXCHANGER
PROCESS REACTOR
REFORMER FURNACE
WATER MAKE-UP
HYDROCARBON FEEDSTOCK
AIR (OR OTHER O2 SOURCE)

METHOD FOR REFORMING HYDROCARBONS

BACKGROUND OF THE INVENTION

1. Field of the Invention

In one aspect, the present invention relates to methods for reforming hydrocarbons in the presence of steam. In another aspect, the present invention relates to apparatus for reforming hydrocarbons in the presence of steam.

2. Background of the Invention

As used in the art, the term "hydrocarbon reforming" generally refers to a catalytic process for dehydrogenating, dehydrocyclizing, aromatizing, and/or isomerizing a hydrocarbon feedstock. Typical reformer feedstocks include alkanes, cycloalkanes, and/or arylalkanes, each having up to 12 carbon atoms, and petroleum fractions such as straight-run naphthas, hydrocracked naphthas, thermally cracked naphthas, catalytically cracked naphthas, and the like. Hydrocarbon reforming can be used, for example, to: produce useful aromatic compounds (e.g., benzene and toluene), olefins, and/or isomers; upgrade the octane ratings of light gasoline fractions; produce highly aromatic aviation blending stocks; and provide substantial quantities of hydrogen which can be used elsewhere in the refinery or chemical plant (e.g., in a hydrodesulfurization unit). Various types of reforming processes are conducted in the presence of steam using steam-active reforming catalysts.

During the course of a steam-active reforming process, the steam-active reforming catalyst will become deactivated due to the deposition of carbonaceous materials on the catalyst's surfaces. These carbonaceous materials will typically consist of coke and/or polymeric substances. In order to remove the carbonaceous materials and thus reactivate the steam-active catalyst, the catalyst must be regenerated.

Depending primarily on the precise nature of the catalyst being used, steam-active reforming catalysts are typically regenerated using either a steam regeneration medium or a steam-diluted oxygen (or air) regeneration medium. When a steam regeneration medium is used, the regeneration steam reacts with the deactivating carbonaceous material to produce hydrogen and carbon monoxide. When a steam-diluted oxygen regeneration medium is used, the oxygen reacts with (i.e., combusts) the deactivating material to produce carbon dioxide and water.

Steam-active reforming processes provide several advantages. For example, the presence of dilution steam during the reforming operation serves to: (1) reduce the partial pressure of the hydrocarbon feedstock and thus provide improved conversion and product selectivity; (2) provide heat for, and moderate temperature losses resulting from, endothermic dehydrogenation and/or dehydrocyclization reactions occurring during the reforming operation; and (3) reduce the rate at which deactivating materials deposit on the catalyst,s surfaces. Additionally, when the catalyst is regenerated using a steam-diluted oxygen (or air) regeneration medium, the regeneration dilution steam absorbs the heat generated by the combustion of the deactivating material and thus serves to moderate temperature increases during the regeneration operation.

U.S. Pat. No. 2,906,696 discloses a process for reforming naphtha using a continuously regenerated activated carbon catalyst. The process of U.S. Pat. No. 2,906,696 is conducted using a fluidized catalyst reactor system. In order to remove carbonaceous deposits from the catalyst,s surfaces without consuming the catalyst itself, the regeneration process of U.S. Pat. No. 2,906,696 must be conducted at high temperature (i.e., 1600°-2200° F.) using a steam regeneration medium. Effluent gases produced during the steam regeneration process are circulated through the hydrocarbon reforming portion of the reactor system to provide a hydrogen-rich environment for the reforming operation.

U.S. Pat. No. 4,613,715 discloses a process for dehydrocyclizing $C_6$–$C_{12}$ alkanes, naphthas, and/or synthetic gasolines in the presence of steam. The steam-active catalyst used in the process of U.S. Pat. No. 4,613,715 consists of a Group II metal aluminate and a Group VIII metal. During the endothermic dehydrocyclization process, reaction temperatures are maintained by injecting oxygen or air into the reaction system. The injection of oxygen generates heat by the combustion of a small amount of feed, hydrogen, and/or coke. The catalyst used in the process of U.S. Pat. No. 4,613,715 is regenerated by stopping the flow of hydrocarbon feed and treating the catalyst with steam diluted air.

U.S. Pat. No. 4,229,609 discloses a process for dehydrogenating a hydrocarbon feedstock using multiple, cyclically operated beds of a steam-active dehydrogenation catalyst. In the process of U.S. Pat. No. 4,229,609, the dehydrogenation reaction is conducted in one or more of the catalyst beds while the remaining catalyst beds are being regenerated. The regeneration of each catalyst bed is accomplished by stopping the flow of hydrocarbon feed thereto and then treating the bed with steam diluted oxygen. The gaseous effluent produced in the regeneration process can be used to indirectly heat the hydrocarbon feedstock. The steam-active catalyst used in the process of U.S. Pat. No. 4,229,609 is composed of: (1) a support select from the group consisting of alumina, silica, magnesia, zirconia, alumina-silicates, Group II aluminate spinels, and mixtures thereof; (2) a catalytically effective amount of at least one Group VIII metal; and, optionally, (3) at least one copromoter metal selected from lead, tin, and germanium.

SUMMARY OF THE INVENTION

The present invention provides a method for reforming a hydrocarbon feedstock and an apparatus for reforming a hydrocarbon feedstock. The present invention can generally be used in conjunction with any steam-active reforming process wherein: (1) a hydrocarbon feedstock is reformed in the presence of steam using a steam-active reforming catalyst; (2) the catalyst is regenerated using a steam-diluted oxygen (or air) regeneration medium; and (3) the hydrocarbon reforming and catalyst regeneration operations are conducted simultaneously. In the present invention, the dilution steam used in the catalyst regeneration operation is advantageously reused in the reforming operation to provide at least a portion of the steam environment required for reforming the hydrocarbon feedstock.

The inventive reforming method comprises the steps of: (a) contacting a first portion of the steam-active reforming catalyst with a regeneration mixture comprising steam and oxygen in order to remove deactivating materials from the catalyst by combustion and produce a regeneration effluent gas stream and (b) reforming the hydrocarbon feedstock in the presence of the regeneration effluent gas stream using a second portion of the steam-active reforming catalyst. The inventive reforming method preferably includes the step, prior to step (b), of removing free oxygen from the regeneration effluent gas stream. Further, the inventive method is preferably conducted using a plurality of cyclically operated fixed beds of steam-active reforming catalyst such that at least one fixed bed of catalyst is regenerated in accordance with step (a) while at least one other fixed bed of catalyst is being used for reforming the hydrocarbon feedstock in accordance with step (b).

The reforming apparatus provided by the present invention comprises: (a) regeneration means for regenerating a first portion of the steam-active reforming catalyst using a regeneration mixture comprising steam and oxygen in order to remove deactivating deposits from the catalyst by combustion and produce a regeneration effluent gas stream; (b) oxygen removing means for removing free oxygen from the regeneration effluent gas stream; (c) reforming means for reforming the hydrocarbon feedstock in the presence of the regeneration effluent gas stream using a second portion of the steam-active reforming catalyst; and (d) conducting means for conducting the regeneration effluent gas stream from the oxygen removing means to the reforming means.

The present invention provides several advantages over the steam-active reforming processes and devices used heretofore. By reusing regeneration diluent steam in the hydrocarbon reforming process, the present invention reduces overall steam usage. Additionally, the present invention reduces cooling water requirements by reducing the total amount of reforming and regeneration steam which must be condensed. Further, by directly mixing the regeneration effluent gas stream with the process feed, the present invention provides a highly efficient means for recovering the combustion heat produced during the catalyst regeneration operation.

Preburning the regeneration effluent gas stream before it is mixed with the hydrocarbon feedstock also provides important operating advantages. Removing free oxygen from the regeneration effluent gas prevents the subsequent consumption (i.e., combustion) of a portion of the hydrocarbon feedstock. Additionally, since the preburned regeneration effluent gas is mixed directly with the hydrocarbon feedstock, preburning the regeneration effluent gas provides a portion of the preheat required for the reforming operation. Further, since the direct mixing of the preburned regeneration effluent with the hydrocarbon feedstock provides a highly efficient means for recovering the heat generated in the preburning operation, the combustible material (e.g., hydrogen-rich recycle gas and/or fuel gas) consumed in the preburning operation replaces more than an equivalent heating value amount of fuel gas which would otherwise be consumed, for preheating purposes, in the reformer furnace.

Other and further objects, features, and advantages of the present invention will readily appear to those skilled in the art upon reference to the drawing and upon reading the following description of the preferred embodiments.

BRIEF DESCRIPTION OF THE DRAWING

The drawing schematically illustrates an embodiment of the apparatus of the present invention.

DESCRIPTION OF THE PREFERRED EMBODIMENTS

As indicated hereinabove, the present invention can generally be used in conjunction with any steam-active reforming process wherein: (1) a hydrocarbon feedstock is reformed in the presence of steam using a steam-active reforming catalyst; (2) the catalyst is regenerated using a steam-diluted oxygen regeneration medium; and (3) the hydrocarbon reforming and catalyst regeneration operations are conducted simultaneously. As used herein and in the claims, the term "steam-diluted oxygen regeneration medium" refers to a steam diluted regeneration medium containing pure oxygen, air, or a similar source of free oxygen.

In the inventive reforming method, the hydrocarbon feedstock is catalytically reformed in the presence of the effluent gas produced in the catalyst regeneration operation. Since, as explained hereinbelow, the regeneration effluent gas consists almost entirely of (a) a large amount of steam and (b) relatively small amounts of inert gases such as $CO_2$ and $N_2$, the presence of the regeneration effluent gas in the hydrocarbon reforming environment effectively replaces a substantially equivalent amount of fresh steam which would otherwise be needed in the reforming operation. Additionally, by directly mixing the regeneration effluent gas with the hydrocarbon feedstock, the present invention provides a highly efficient means for recovering the heat of combustion produced during the regeneration process.

In addition to containing relatively small amounts of inert gases such as $CO_2$ and $N_2$, the regeneration effluent gas will most likely contain a small amount of free oxygen which was not consumed during the regeneration operation. When the oxygen-containing regeneration effluent gas is mixed directly with the hydrocarbon feedstock, the free oxygen component of the regeneration effluent gas consumes (i.e., combusts) a small amount of the hydrocarbon feedstock and thus provides a portion of the preheat required for the reforming operation.

According to the present invention, free oxygen contained in the regeneration effluent gas is preferably consumed before the regeneration effluent gas is mixed with the hydrocarbon feedstock. The free oxygen is preferably consumed by adding a combustible gas (e.g., hydrogen-rich off gas produced during the reforming process and/or plant fuel gas) to the regeneration effluent gas in an amount sufficient to react with essentially all of the free oxygen. Preburning the regeneration effluent gas in this manner advantageously prevents the consumption of valuable hydrocarbon feedstock and provides a highly efficient means for preheating the hydrocarbon feedstock using a less valuable combustible gas. Since the preburned regeneration effluent gas is mixed directly with the hydrocarbon feedstock, the combustible gas used in the preburn operation effectively replaces at least an equivalent BTU value amount of plant fuel gas which would otherwise be consumed, for preheating purposes, in the reformer furnace.

As mentioned above, the inventive method is used in conjunction with hydrocarbon reforming systems wherein the reforming operation and the regeneration operation are conducted simultaneously. For example, the inventive method can be used in conjunction with a continuously regenerated, fluidized catalyst reforming system; a multiple, cyclically operated, fixed catalyst bed reforming system; or a combination thereof. The inventive method is preferably used in conjunction with a multiple, cyclically operated, fixed bed reforming system which requires frequent catalyst regeneration. When a multiple, cyclically operated, fixed bed reactor system is employed, at least one bed of active catalyst is used in the reforming operation while at least one bed of deactivated catalyst is being regenerated. When the regeneration operation is completed, the regenerated bed is placed in service while another of the fixed beds is regenerated. If the regeneration of one catalyst bed is completed well before another catalyst bed is ready for regeneration, the inventive method can be continued, for example, by simply stopping the flow of oxygen (or air) to the newly regenerated catalyst bed while maintaining a constant flow of regeneration dilution steam thereto.

The hydrocarbon feedstock used in the present invention can generally be any type of feedstock which has been used heretofore in a steam-active reforming process. Examples include: $C_2$–$C_{12}$ alkanes and isoalkanes; cycloalkanes having up to 12 carbon atoms; arylalkanes having up to 12 carbon atoms; light gasoline fractions; virgin naphthas; hydrocracked naphthas; thermally cracked naphtha fractions; catalytically cracked naphtha fractions; and the like. The present invention is particularly well suited for use in the dehydrogenation of propane and/or isobutane and in the dehydrocyclization of $C_6$–$C_9$ naphthas.

The catalyst used in the present invention can generally be any known steam-active reforming catalyst which can be regenerated using a steam-diluted oxygen regeneration medium. Steam-active catalysts suitable for use in the present invention, and methods for producing such catalysts, are disclosed, for example, in U.S. Pat. Nos. 4,613,715; 3,670,044; 3,641,182; 4,167,472; and 4,229,609, the entire disclosures of which are incorporated herein by reference. As is known in the art, the form of catalyst (e.g., granules, pills, pellets, spheres, and the like) preferred for use in a given reforming operation will generally be determined by such factors as: the specific catalyst selected; the type of reforming system being used (i.e., fluidized bed, fixed bed, etc.); and availability.

The steam-active reforming catalyst used in the present invention preferably contains a catalytically effective amount of at least one metal from Group VIII of the Periodic Table of Elements. Suitable Group VIII metals include nickel, platinum, ruthenium, palladium, iridium, rhodium, osmium, and combinations thereof. The steam-active reforming catalyst used in the present invention most preferably contains a catalytically effective amount of platinum.

Steam-active reforming catalysts which are particularly well suited for use in the present invention are composed of: (a) a support selected from alumina, silica, magnesia, zirconia, Group II aluminate spinels, or mixtures thereof; (b) a catalytically effective amount (i.e., at least about 0.01 percent by weight, and preferably from about 0.1 percent to about 10 percent by weight, based on the weight of the support) of at least one of the Group VIII metals listed above; and, optionally, (c) up to about 10 percent by weight, based on the weight of the support, of a copromoter material selected from the group consisting of tin, lead, germanium, alkali metals, and combinations thereof. Such catalysts are highly selective and highly active for feedstock dehydrogenation.

Group II aluminate spinels are compounds of the formula $M(AlO_2)_2$ or $MO.Al_2O_3$ wherein M is a divalent Group IIA or Group IIB metal (i.e., Zn, Mg, Be, Ca, and the like). A steam-active catalyst composed of zinc aluminate spinel impregnated with platinum is most preferably used in the present invention.

The inventive reforming method should generally be performed at operating conditions which are suitable for both the steam-active catalyst and the hydrocarbon feedstock being used. If a Group VIII metal-containing catalyst is employed, the inventive reforming method is preferably conducted using: reforming and regeneration temperatures in the range of from about 750° F. to about 1250° F.; reforming and regeneration pressures in the range of from about 0 to about 500 psig; a hydrocarbon feedstock flow rate in the range of from about 0.5 to about 6 volumes of liquid hydrocarbon feedstock (determined at 32° F. and 14.7 psia) per volume of catalyst per hour; a steam to feedstock mole ratio, in the reforming operation, of from about 0.5:1 to about 30:1; a hydrogen to feedstock mole ratio, in the reforming operation, of from 0:1 to about 2:1; and a steam-diluted oxygen regeneration medium comprising from about 0.5 to about 2.50 moles of oxygen per 100 moles of steam. When a Group VIII metal-containing catalyst, particularly a platinum-containing catalyst, is used, reforming and regeneration temperatures must be maintained below about 1500° F. in order to prevent catalyst sintering. The reforming and regeneration operations of the inventive reforming method are most preferably conducted at temperatures in the range of from about 1,000° F. to about 1,200° F. and at pressures in the range of from about 0 to about 200 psig.

An embodiment 2 of the apparatus of the present invention is depicted in the drawing. Apparatus 2 utilizes two cyclically operated fixed bed reactors, 16 and 20. Hydrocarbon feedstock is conducted to reformer furnace 6 of apparatus 2 by conduit 4. Prior to entering the reformer furnace, the hydrocarbon feedstock is mixed with regeneration effluent gas and make-up water. The regeneration effluent gas and make-up water are conducted to conduit 4 by conduit 8. The hydrocarbon feedstock, regeneration effluent gas, and make-up water feed mixture formed in conduit 4 is heated sufficiently in reformer furnace 6 to vaporize the hydrocarbon feedstock and the make-up water and to achieve a feed mixture temperature suitable for reforming the hydrocarbon feedstock.

The heated feed mixture is conducted from reformer furnace 6 to manifold 12 by conduit 10. Manifold 12 is connected between the inlet 14 of reactor 16 and the inlet 18 of reactor 20. Switching valves 22 and 24 are disposed in manifold 12 to direct the flow of the feed mixture to either reactor 16 or reactor 20. Since, as depicted in embodiment 2, valve 22 is currently open and valve 24 is currently closed, the feed mixture is being directed to reactor 16. Thus, reactor 16 is currently operating as the hydrocarbon reforming reactor.

Reactors 16 and 20 contain fixed beds 26 and 28 of a suitable steam-active reforming catalyst. As depicted in the drawing, the hydrocarbon feedstock is currently being reformed, in the presence of steam and minor amounts of inert regeneration effluent gases, in fixed catalyst bed 26 to produce a reforming operation effluent stream. The reforming operation effluent stream is conducted from reactor 16 by conduit 30.

The reforming operation effluent stream is conducted by conduit 30 to manifold 32. Manifold 32 is connected between the outlet 30 of reactor 16 and the outlet 34 of reactor 20. Switching valves 36 and 38 are disposed within manifold 32 so that the reforming operation effluent stream can be directed to manifold 32 from whichever reactor happens to be operating in the reforming mode. Since reactor 16 is currently operating in the reforming mode, valve 36 is open and valve 38 is closed.

The reforming operation effluent stream is conducted by conduit 40 from manifold 32 to heat exchanger 42. In heat exchanger 42, the reforming operation effluent stream is used to heat process water and make-up water which will subsequently be used in the catalyst regeneration operation. After cooling in exchanger 42, the reforming operation effluent stream is conducted by conduit 44 from exchanger 42 to product recovery system 46.

In a typical product recovery system, the reforming operation effluent stream is cooled, if necessary, and then allowed to separate to form a liquid process water phase, a liquid reformate product phase, and a hydrogen-rich product gas phase. The product gas can be further treated, for example, with an amine absorbent to remove carbon dioxide therefrom. As depicted in the drawing, process water, carbon dioxide, and hydrogen-rich gas are conducted from product recovery system 46 by conduits 48, 50, and 54. Liquid reformate product is conducted by conduit 52 from product recovery system 46 to storage or to other separation, recovery, and/or treatment systems located downstream. As is apparent, product recovery system 46 contains pumps, compressors, and other equipment needed for handling and delivering the various product streams recovered in system 46.

Process water and make-up water for use in the catalyst regeneration operation (i.e., for use as regeneration dilution steam) are delivered to reformer furnace 6 by conduit 58. As indicated above, process water is initially conducted from product recovery system 46 by conduit 48. A process water blow down means 60 is provided in conduit 48 so that a portion of the process water can be periodically or continually removed from the reformer system. The continual or periodic removal of a portion of the process water operates to remove excess water from the process water system and/or prevent excessive contaminant buildup in the process water system. After a portion of the process water is removed from conduit 48, make-up water is added to conduit 48, as needed, via conduit 62. The resulting process water and make-up water mixture is conducted by conduit 48 to heat exchanger 42. As discussed above, the process water and make-up water are heated in the heat exchanger 42 by indirect heat exchange with the reforming operation effluent stream. After being heated in heat exchanger 42, the process water and make-up water mixture is conducted from exchanger 42 by conduit 58.

Air, or some other source of free oxygen, is added, via conduit 56, to conduit 58 at a point upstream of reformer furnace 6. The resulting mixture of air, process water, and make-up water formed in conduit 58 is heated sufficiently in furnace 6 to form a steam diluted oxygen regeneration medium suitable for regenerating the steam-active catalyst contained in fixed bed 28. The heated regeneration medium is conducted by conduit 64 from furnace 6 to manifold 66. Manifold 66 is connected between the inlet 14 of reactor 16 and the inlet 18 of reactor 20. Switching valves 68 and 70 are disposed within manifold 66 so that the heated regeneration medium can be directed to either reactor 16 or reactor 20. Since, as depicted in the drawing, catalyst bed 28 in reactor 20 is currently being regenerated, valve 70 is closed and valve 68 is open.

As the catalyst in reactor 20 is being regenerated, the free oxygen component of the regeneration medium reacts with (i.e., combusts) deactivating carbonaceous materials which have deposited on the catalyst. The combustion of the carbonaceous materials produces carbon dioxide and water. As indicated above, the steam-diluted oxygen regeneration medium used to regenerate catalyst bed 28 consists of: (a) a large amount of steam, (b) a small amount of oxygen (i.e., from about 0.5 to about 2.5 moles of oxygen per 100 moles of steam); and, if air is used as the oxygen source, (c) from about 2 to about 10 moles of nitrogen per 100 moles of steam. Thus, a regeneration effluent gas stream is formed in reactor 20 which consists primarily of: (a) a large amount of steam; (b) a small amount of carbon dioxide and unreacted oxygen; and, if air is used as the oxygen source, (c) up to about 10 moles of nitrogen per 100 moles of steam.

The regeneration effluent gas stream is conducted by conduit 34 from reactor 20 to manifold 72. Manifold 72 is connected between the outlet 30 of reactor 16 and the outlet 34 of reactor 20. Switching valves 74 and 76 are disposed within manifold 72 so that the regeneration effluent gas stream can be received from whichever reactor is operating in the regeneration mode. Since reactor 20 is currently operating in the regeneration mode, valve 74 is open and valve 76 is closed.

The regeneration effluent gas stream is conducted from manifold 72 by conduit 8. A vent 78 is provided in conduit 8 so that a portion of the regeneration effluent gas can be vented from the regeneration effluent system, as needed, to remove excess steam. A small amount of hydrogen-rich recycle gas is added to the regeneration effluent gas at a point downstream of vent 78. Said small amount of recycle gas is added to the regeneration effluent gas stream via conduit 80 which is connected between conduit 8 and product gas conduit 54.

As discussed above, the amount of recycle gas added to the regeneration effluent is preferably an amount sufficient to consume substantially all of the free oxygen contained in the regeneration effluent gas stream. Following recycle gas addition, make-up water is added to the regeneration effluent stream, as needed, via conduit 82. Subsequently, the regeneration effluent gas stream is combined with the hydrocarbon feedstock in the manner set forth above.

Reactors 16 and 20 are cyclically operated such that one reactor (i.e., reactor 16 as depicted in the drawing) is used for reforming the hydrocarbon feedstock while the other reactor (i.e., reactor 20 as depicted in the drawing) is being regenerated. When reactor 20 is sufficiently regenerated, valves 24, 38, 70, and 76 will be opened and valves 22, 36, 68, and 74 will be closed so that reactor 20 will be used for reforming the hydrocarbon feedstock while reactor 16 is being regenerated.

Although only two reactors are shown in the drawing, the apparatus of the present invention can generally contain any number of cyclically operated fixed bed reactors. For example, if the apparatus utilizes four fixed bed reactors, each of said reactors operating on a six-hour process cycle followed by a two-hour regeneration cycle, the four reactor system could be continuously operated with three reactors in the reforming mode and one reactor in the regeneration mode. In this mode of operation, a different reactor would be regenerated every two hours.

The following examples are provided in order to further illustrate the present invention.

EXAMPLE I

A hydrocarbon feedstock stream consisting primarily of isobutane is reformed in the presence of steam using a steam-active reforming catalyst. The steam-active reforming catalyst consists of a zinc aluminate spinel support impregnated with platinum. The reforming operation is conducted using four fixed catalyst bed reactors, each individual reactor operating on a six-hour process cycle followed by a two-hour regeneration cycle. The reforming operation is conducted at a temperature of about 1000° F., a pressure of about 90 psia, and a steam to hydrocarbon feedstock mole ratio of 5:1. The catalyst regeneration operation is conducted using a steam-diluted air regeneration medium containing approximately 2.3 moles of oxygen per 100 moles of steam. The regeneration operation is conducted at a temperature of about 1100° F. and a pressure of about 90 psia. In this Example, the regeneration effluent gas is not reused in the reforming operation. The compositions of the process and regeneration feed streams used in this Example and the compositions of the process and regeneration effluent product streams obtained are provided in Table I.

TABLE I

EXAMPLE I - FEED AND PRODUCT COMPOSITIONS

| Components | Steam diluted hydrocarbon feedstock (moles/hr) | Steam diluted air regeneration medium (moles/hr) | Process effluent (moles/hr) | Regeneration effluent (moles/hr) |
|---|---|---|---|---|
| $H_2$ | | | 970.65 | |
| $N_2$ | | 235.72 | | 235.72 |
| $O_2$ | | 62.70 | | 53.25 |
| CO | | | 8.04 | |
| $CO_2$ | | | 48.93 | 7.56 |
| $C_1$ | | | 19.62 | |
| $C_2$ | | | 4.98 | |
| propene | | | 11.49 | |
| propane | 40.47 | | 46.98 | |
| I-butane | 1608.72 | | 804.36 | |
| i-butene | | | 765.12 | |
| butene-1 | | | 9.09 | |
| butadiene | | | | |
| n-butane | 52.47 | | 25.20 | |
| t-butene-2 | | | 9.09 | |
| c-butene-2 | | | 9.09 | |
| $C_{5+}$ | | | 1.38 | |
| Total | 1701.66 | 298.42 | 2734.02 | 296.53 |
| Total Steam use or content | 8508.81 | 2836.27 | 8403.06 | 2840.05 |
| New steam required | 8508.81 | 2836.27 | | |
| Regeneration steam reused | | | | |

Total New Steam Required = 11345.08 moles/hr

EXAMPLE II

The process of Example I is repeated except that the effluent gas produced during the regeneration operation is combined with the process feed to provide a portion of the diluent gas required in the reforming operation. By reusing the regeneration diluent steam in the reforming operation, total steam usage is reduced by 25 percent. The product yields obtained in this example are essentially identical to the yields obtained in Example I. Less than 0.1 mole percent of the hydrocarbon feedstock is consumed by free oxygen which is present in the regeneration effluent gas. The compositions of the feed streams used and effluent product obtained in this example are provided in Table II.

TABLE II

EXAMPLE II - FEED AND PRODUCT COMPOSITIONS

| Components | Steam diluted hydrocarbon feedstock (moles/hr) | Steam diluted air regeneration medium (moles/hr) | Process effluent (moles/hr) |
|---|---|---|---|
| $H_2$ | | | 970.65 |
| $N_2$ | | 235.72 | 235.72 |
| $O_2$ | | 62.70 | |
| CO | | | 8.04 |
| $CO_2$ | | | 89.26 |
| $C_1$ | | | 19.62 |
| $C_2$ | | | 4.98 |
| propene | | | 11.49 |
| propane | 40.47 | | 46.98 |
| i-butane | 1608.72 | | 796.17 |
| i-butene | | | 765.12 |
| butene-1 | | | 9.09 |
| butadiene | | | |
| n-butane | 52.47 | | 25.20 |
| t-butene-2 | | | 9.09 |
| c-butene-2 | | | 9.09 |
| $C_{5+}$ | | | 1.38 |
| Total | 1701.66 | 298.42 | 3001.88 |
| Total Steam use or content | 8508.81 | 2836.27 | 8447.80 |
| New steam required | 5668.76 | 2836.27 | |
| Regeneration steam reused | 2840.05 | | |

Total New Steam Required = 8505.03

EXAMPLE III

Example II is repeated except for the fact that, prior to combining the hydrocarbon feedstock and regeneration effluent streams, 278 moles/hr of hydrogen-rich recycle gas are added to the regeneration effluent in order to remove all free oxygen from the regeneration effluent. The process of this example uses 25 percent less steam than is used in the process of Example I and provides the same product yields obtained in the process of Example I. The compositions of the feed streams used in this example and the composition of the product obtained are provided in Table III.

TABLE III

EXAMPLE III - FEED AND PRODUCT COMPOSITIONS

| Components | Steam diluted hydrocarbon feedstock (moles/hr) | Steam diluted air regeneration medium (moles/hr) | $H_2$-rich recycle gas added to regeneration effluent (moles/hr) | Process effluent (moles/hr) |
|---|---|---|---|---|
| $H_2$ | | | 250 | 1095.25 |
| $N_2$ | | 235.72 | 28 | 263.72 |
| $O_2$ | | 62.70 | | |
| CO | | | | 8.04 |
| $CO_2$ | | | | 48.93 |
| $C_1$ | | | | 19.62 |
| $C_2$ | | | | 4.98 |
| propene | | | | 11.49 |
| propane | 40.47 | | | 46.98 |
| i-butane | 1608.72 | | | 804.36 |
| i-butene | | | | 765.12 |
| butene-1 | | | | 9.09 |
| butadiene | | | | |
| n-butane | 52.47 | | | 25.20 |
| t-butene-2 | | | | 9.09 |
| c-butene-2 | | | | 9.09 |
| $C_5$+ | | | | 1.38 |
| Total | 1701.66 | 298.42 | 278 | 3122.34 |
| Total steam use or content | 8508.81 | 2836.27 | | 8403.06 |
| New steam required | 5668.76 | | | |
| Regeneration steam reused | 2840.05 | | | |
| | | Total New Steam Required = 8505.03 | | |

Thus, the present invention is well adapted to carry out the objects and obtain the ends and advantages mentioned above as well as those inherent therein. While presently preferred embodiments have been described for purposes of this disclosure, numerous changes in the arrangement of method steps and apparatus parts will be apparent by those skilled in the art. Such changes are encompassed within the spirit of this invention as defined by the appended claims.

We claim:

1. A method for reforming a hydrocarbon feedstock using a steam-active reforming catalyst, said method comprising the steps of:

(a) contacting a first portion of said catalyst with a regeneration mixture consisting essentially of steam and a source of free oxygen in order to remove deactivating material from said first portion of catalyst by combustion and produce a regeneration effluent gas stream consisting essentially of steam, inert gas, and any of said free oxygen which is not consumed when said deactivating material is removed from said first portion of catalyst;

(b) removing from said regeneration effluent gas stream said free oxygen which is not consumed when said deactivating material is removed from said catalyst; and (c) reforming said hydrocarbon feedstock in the presence of said regeneration effluent gas stream using a second portion of said catalyst.

2. The method of claim 1 wherein said stream-active reforming catalyst comprises a metal from Group VIII of the Periodic Table of Elements.

3. The method of claim 2 wherein step (a) is conducted at a temperature in the range of from about 750° F. to about 1250° F.

4. The method of claim 3 wherein said steam-active reforming catalyst comprises platinum.

5. The method of claim 3 wherein said steam-active reforming catalyst comprises:

a support selected from alumina, silica, magnesia, zirconia, Group II aluminate spinels, or mixtures thereof and a catalytically effective amount of a catalytic material selected from nickel, platinum, palladium, ruthenium, iridium, osmium, rhodium, or a combination thereof.

6. The method of claim 5 wherein said support is a zinc aluminate spinel and said catalytic material is platinum.

7. The method of claim 1 wherein said regeneration mixture used in step (a) includes from about 0.5 moles to about 2.5 moles of said free oxygen per 100 moles of said steam.

8. The method of claim 1 wherein said step of removing free oxygen is accomplished by admixing a combustible material with said regeneration effluent gas stream.

9. The method of claim 8 wherein said combustible material is fuel gas, hydrogen-rich reformer recycle gas, or a combination thereof.

10. The method of claim 1 wherein said method is conducted using a plurality of cyclically operated fixed beds of said steam-active reforming catalyst such that at least one fixed bed of said catalyst is regenerated in accordance with step (a) while at least one other fixed bed of said catalyst is used for reforming said hydrocarbon feedstock in accordance with contacting step (b).

11. A method for reforming a hydrocarbon feedstock using a steam-active reforming catalyst which includes a metal from Group VIII of the Periodic Table of Elements, said method comprising the steps of:

(a) contacting a first fixed bed of said catalyst with a regeneration mixture consisting essentially of steam and a source of free oxygen in order to remove deactivating material from said catalyst in said first bed by combustion and produce a regeneration effluent gas stream consisting essentially of steam, inert gas, and free oxygen which is not consumed when said deactivating material is removed from said catalyst in said first bed;

(b) removing from said regeneration effluent gas stream said free oxygen which is not consumed when said deactivating material is removed from said catalyst in said first bed; and (c) reforming said hydrocarbon feedstock in a second fixed bed of said catalyst and in the presence of said regeneration effluent gas stream.

12. The method of claim 11 wherein step (a) is conducted at a temperature in the range of from about 750° F. to about 1250° F.

13. The method of claim 11 wherein said steam-active reforming catalyst comprises:

a support selected from alumina, silica, magnesia, zirconia, Group II aluminate spinels, or mixtures thereof and a catalytically effective amount of a catalytic material selected from nickel, platinum, palladium, ruthenium, iridium, osmium, rhodium, or a combination thereof.

14. The method of claim 11 wherein said regeneration mixture used in step (a) comprises from about 0.5 moles to about 2.5 moles of oxygen per 100 moles of steam.

15. The process of claim 11 wherein free oxygen is removed from said regeneration effluent gas stream in accordance with step (b) by admixing a combustible material with said regeneration effluent gas stream.

* * * * *

UNITED STATES PATENT AND TRADEMARK OFFICE

CERTIFICATE OF CORRECTION

PATENT NO. : 5,235,121

DATED : August 10, 1993

INVENTOR(S) : Francis M. Brinkmeyer et al.

It is certified that error appears in the above-identified patent and that said Letters Patent is hereby corrected as shown below:

Col. 11, claim 2, line 63, change "stream-active" to --steam-active--.

Signed and Sealed this

Twenty-ninth Day of March, 1994

*Attest:*

Bruce Lehman

BRUCE LEHMAN

*Attesting Officer*

*Commissioner of Patents and Trademarks*